US008127375B2

(12) United States Patent
Pierce

(10) Patent No.: US 8,127,375 B2
(45) Date of Patent: Mar. 6, 2012

(54) LOW PROFILE HELMET VENTS AND VENTING SYSTEM

(75) Inventor: Brendan Erik Pierce, San Jose, CA (US)

(73) Assignee: Fox Racing, Inc., Morgan Hill, CA (US)

( * ) Notice: Subject to any disclaimer, the term of this patent is extended or adjusted under 35 U.S.C. 154(b) by 805 days.

(21) Appl. No.: 11/434,304

(22) Filed: May 15, 2006

(65) Prior Publication Data

US 2008/0134415 A1 Jun. 12, 2008

(51) Int. Cl.
*A63B 71/10* (2006.01)

(52) U.S. Cl. ..... 2/425; 2/410

(58) Field of Classification Search ..... 2/410, 411, 2/425

See application file for complete search history.

(56) References Cited

U.S. PATENT DOCUMENTS

| | | | | |
|---|---|---|---|---|
| 4,163,415 | A * | 8/1979 | Neveux | 454/124 |
| 4,704,746 | A * | 11/1987 | Nava | 2/424 |
| 5,093,938 | A * | 3/1992 | Kamata | 2/424 |
| 5,345,614 | A * | 9/1994 | Tanaka | 2/425 |
| 5,991,930 | A * | 11/1999 | Sorrentino | 2/424 |
| 6,105,172 | A * | 8/2000 | Shida | 2/171.3 |
| 6,263,513 | B1 * | 7/2001 | Murakami | 2/171.3 |
| 6,317,891 | B1 * | 11/2001 | Gafforio | 2/171.3 |
| 6,961,963 | B2 * | 11/2005 | Rosie | 2/171.3 |
| 2004/0158914 | A1 * | 8/2004 | Tanaka | 2/410 |

* cited by examiner

*Primary Examiner* — Shaun R Hurley
*Assistant Examiner* — Andrew Sutton
(74) *Attorney, Agent, or Firm* — Michael A Guth

(57) ABSTRACT

A motorcycle helmet vent and venting system that is low profile and does not take up much space on the helmet shell. A motorcycle vent that pivots internally to allow air flow and pivots such that the vent tab may penetrate the outer plane of the helmet shell. A motorcycle helmet with raised portions in its shell rearward of vents in the helmet shell.

14 Claims, 17 Drawing Sheets

LOW PROFILE HELMET VENTS AND VENTING SYSTEM

BACKGROUND OF THE INVENTION

1. Field of Invention

The present invention related generally to the field of helmets, and more specifically to a low profile venting system using helmet vents.

2. Description of Related Art

Safety helmets for motorcycles are typically made in the form of a complete cap that provides an opening in the area of the user's eyes. The helmets are generally provided with an external shell, made from a rigid and strong material, such as polycarbonate, or composite materials, coupled with safety padding inside the shell. The safety padding is often made of expanded polystyrene, expanded polypropylene, or foamed polyurethane, and is itself often lined with a soft material in order to provide comfort to the wearer.

Prior art devices have addressed the need for ventilation in motorcycle helmets. For example, U.S. Pat. No. 5,086,520 to Arai utilizes an air inlet on the top portion of the shell to allow for the introduction of air into the shell. This device delivers air to the top of the head and is limited in the manner in which it can cool or dehumidify the interior of the helmet shell.

U.S. Pat. No. 4,555,816 to Broersma illustrates a motorcycle helmet which utilizes air inlets in the cheek bar itself. Although the air inlet is in the external portion of the cheek bar, the air itself is routed outside the foamed polyurethane liner and then through passages where it can then ventilate the sides, top, and rear of the user's head.

What is needed is a low profile opening and closing vent for a motorcycle helmet that can provide sufficient ventilation without taking too much space on the outer surface of the helmet shell.

BRIEF SUMMARY OF THE INVENTION

A motorcycle helmet vent and venting system that is low profile and does not take up much space on the helmet shell. A motorcycle vent that pivots internally to allow air flow and pivots such that the vent tab may penetrate the outer plane of the helmet shell.

DETAILED DESCRIPTION

Figure 1:
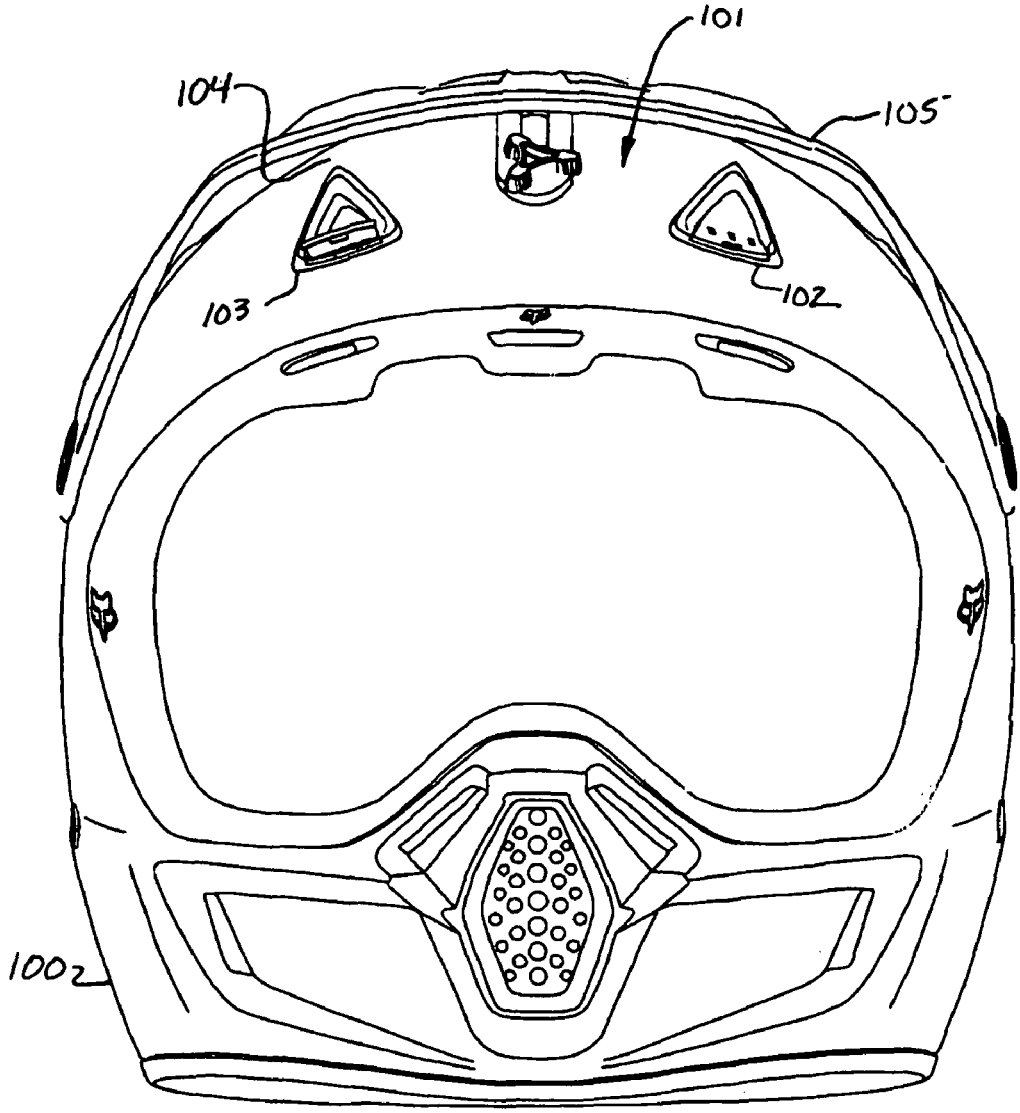
FIG. 1 is a front view of a motorcycle helmet according to some embodiments of the present invention.

In some embodiments of the present invention, as seen in FIG. 1, a motorcycle helmet 100 has vents 102, 103 affixed on the outer shell 101 of the helmet. In some embodiments, there are two vents. In some embodiments, there are two vents spaced apart over the forehead of the wearer. In some embodiments, the outer shell 101 of the motorcycle helmet 100 has raised portions 104 adapted for the enhancement of air flow within the helmet. The vents 102, 103 may be placed in the outer shell 101 such that the air flow inlet that the vents provide feeds into an area under the raised portions 104. In some embodiments, a visor 105 is affixed to the helmet 100 in the area adjacent to and above the vents 102, 103. The visor may serve a multitude of functions, including that of a sun shade for the wearer's eyes. The visor 105 may also facilitate air flow into the vents while the user is in forward motion. The visor 105 may also be shaped to enhance air flow into the vents.

Figure 2:
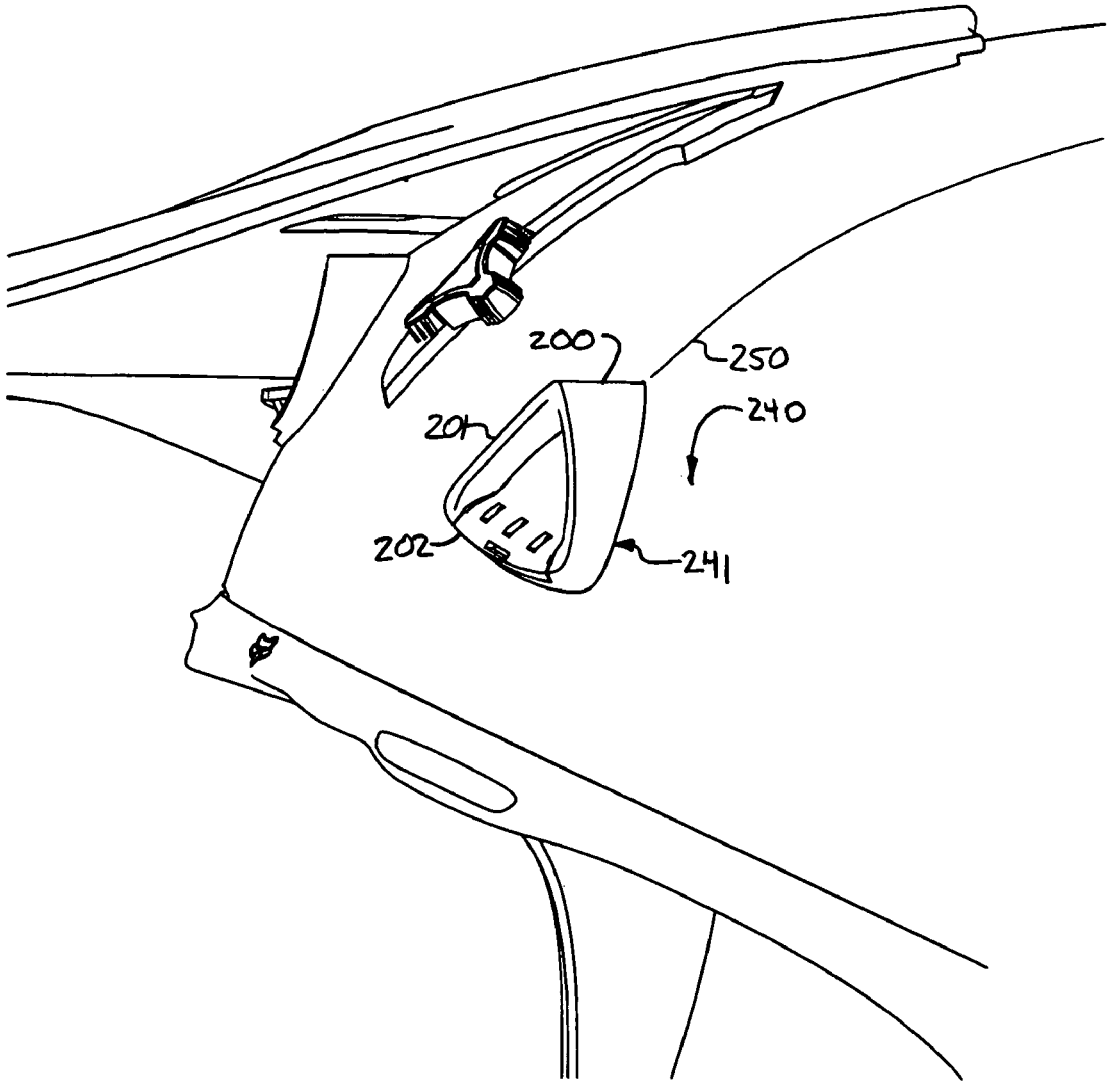
FIG. 2 is a perspective view of a vent on a helmet according to some embodiments of the present invention.
Figure 3:
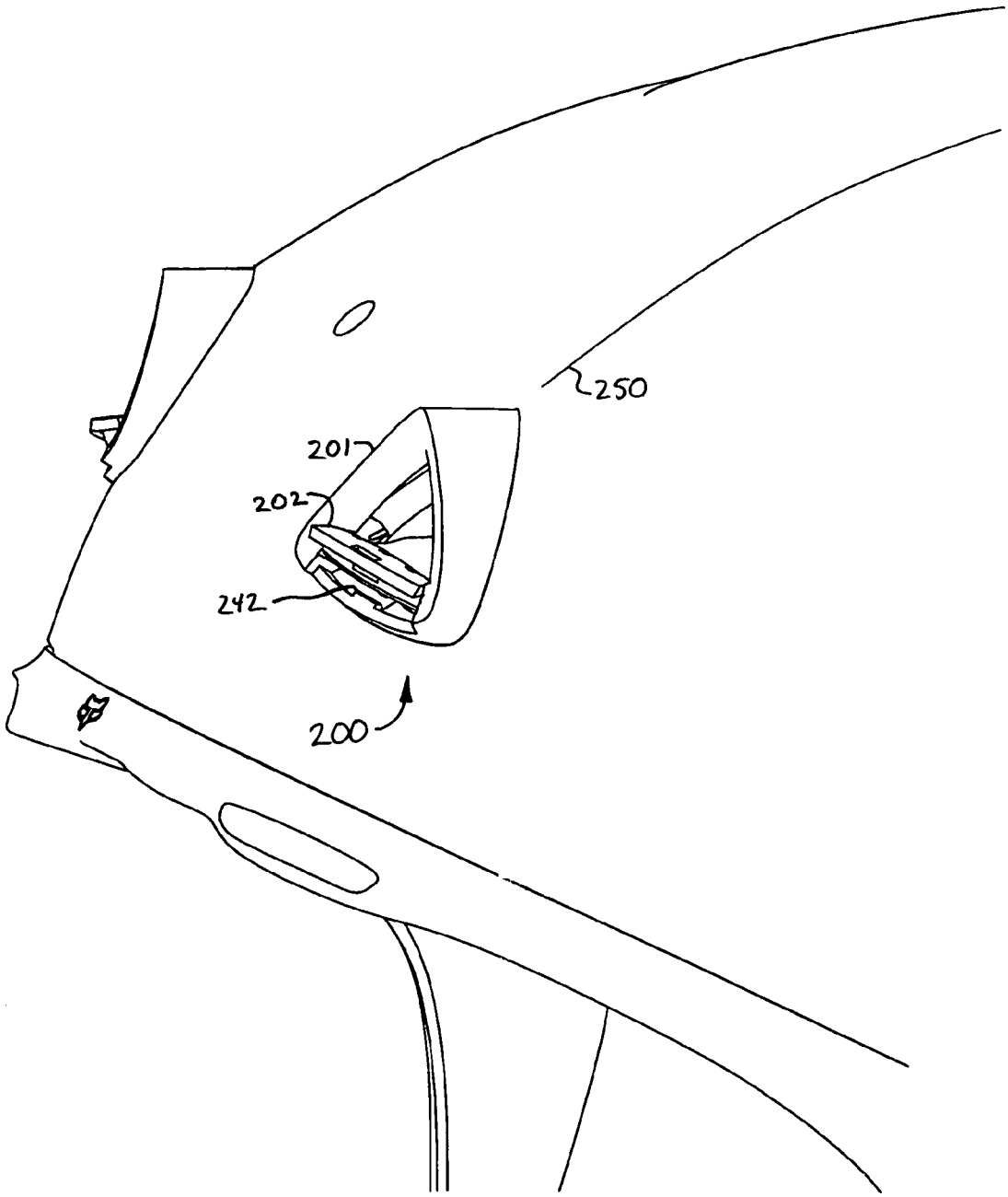
FIG. 3 is a perspective view of a vent on a helmet according to some embodiments of the present invention.

FIGS. 2 and 3 illustrate a vent mechanism 200 affixed to the outer surface 240 of a motorcycle helmet. In some embodiments, the vent mechanism 200 is made of two pieces. The base unit 201 is affixed to the helmet along a plane of contact 241. The plane of contact 241 may not be a flat plane in some embodiments, but a variable plane that follows the contours of the outer surface 240 of the helmet. The plane of contact 241 may be partially or fully below the outer surface 240 in some embodiments. A vent tab 202 resides within the base unit 201 and is adapted to be opened to allow for the venting of air into the helmet. In some embodiments, a snap 242 holds the vent tab 202 into a closed position within the base unit 201. The snap may be overcome with gentle pressure upwards on the vent tab 202 in the area near the snap 242, or more typically by pressing on the vent tab 202 on the tab portion 205, in conjunction with lifting up on the lever portion 206.

In some embodiments, the outer surface 240 of the helmet has one or more raised portions 250. A raised portion 250 may be situated such that an air flow channel exists inside the helmet in the area under the raised portion 250. In some embodiments, the shape of the vent tab 202 is adapted to simulate to some degree the shape of the air flow channel within the helmet under the raised portion 250.

Figure 4:
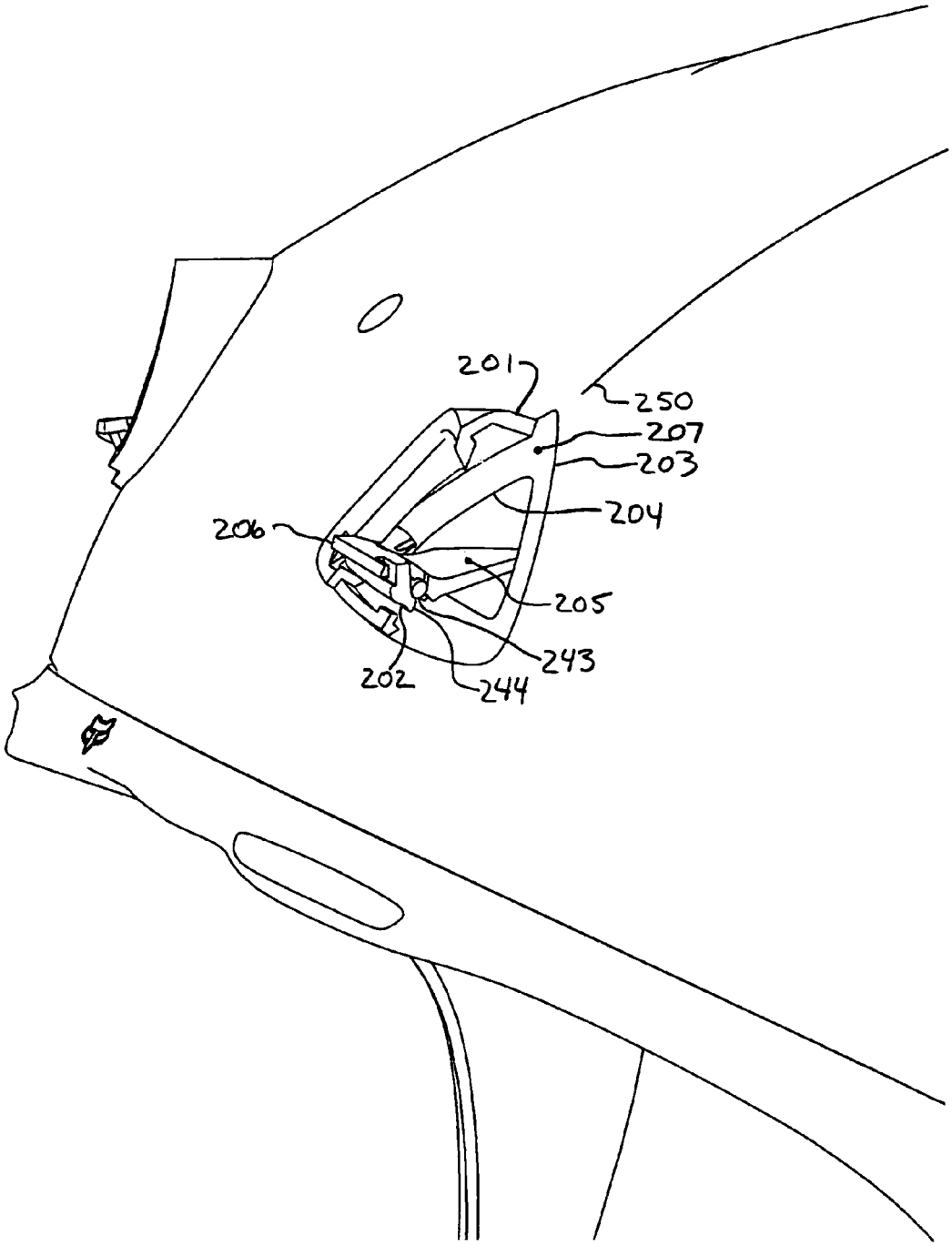
FIG. 4 is a cutaway view of a vent on a helmet according to some embodiments of the present invention.

FIG. 4 illustrates a cutaway cross-sectional view of vent mechanism on a helmet shell with the vent tab 202 in an open position. The base unit 201 of the vent mechanism is affixed to the outer surface of the helmet. In some embodiments, the periphery of the hole 204 in the outer shell has a tapered portion 207 which tapers down from the outer surface of the shell down towards the inner edge periphery. The outer edge 203 of the tapered portion is part of the outer surface 240 of the helmet shell. In some embodiments, the base unit 201 is mounted around the inside of the outer edge 203 of the tapered portion 207. The helmet may have a raised portion 250 which may be situated such that an air flow channel exists inside the helmet in the area under the raised portion 250.

The vent tab 202 may be pivotally attached to the base unit 201 in some embodiments. A pivot pin 243 may be an integral part of the base unit 201 in some embodiments. The vent tab 202 may have clip portions 244 adapted to clip onto the pivot pin 243. The pivot pin 243 and the clip portion 244 may work together to allow for the pivoting on the vent tab 202 in the fashion of a hinge. The vent tab may be conceptually divided at the pivot line into a tab portion 205 and a lever portion 206.

The lever portion 206 may be used by the wearer of the helmet to open the vent by lifting the lever portion. The tab portion 205 may be used to open the vent by pushing on the surface of the tab portion 205.

The vent tab 202 may be pivoted such that the tab portion 205 pivots through a pivot arc that may take part of the tab portion 205 through the hole 204 in the outer shell and into the area within the opening in the outer shell. This allows for a vent which takes up very little space on the outer surface of the helmet. The vent tab 202 may pivot such that the tab portion 205 partially enters the space below the inner surface of the outer shell of the helmet in some embodiments. The vent tab 202 and the base unit 201 may be adapted such that there are one or more locking positions along the pivot arc such that the vent tab 202 may be locked into closed, partially open, or fully open positions. In some embodiments, the vent tab may be moved from the locking positions with gentle pressure by the user.

Figure 5:
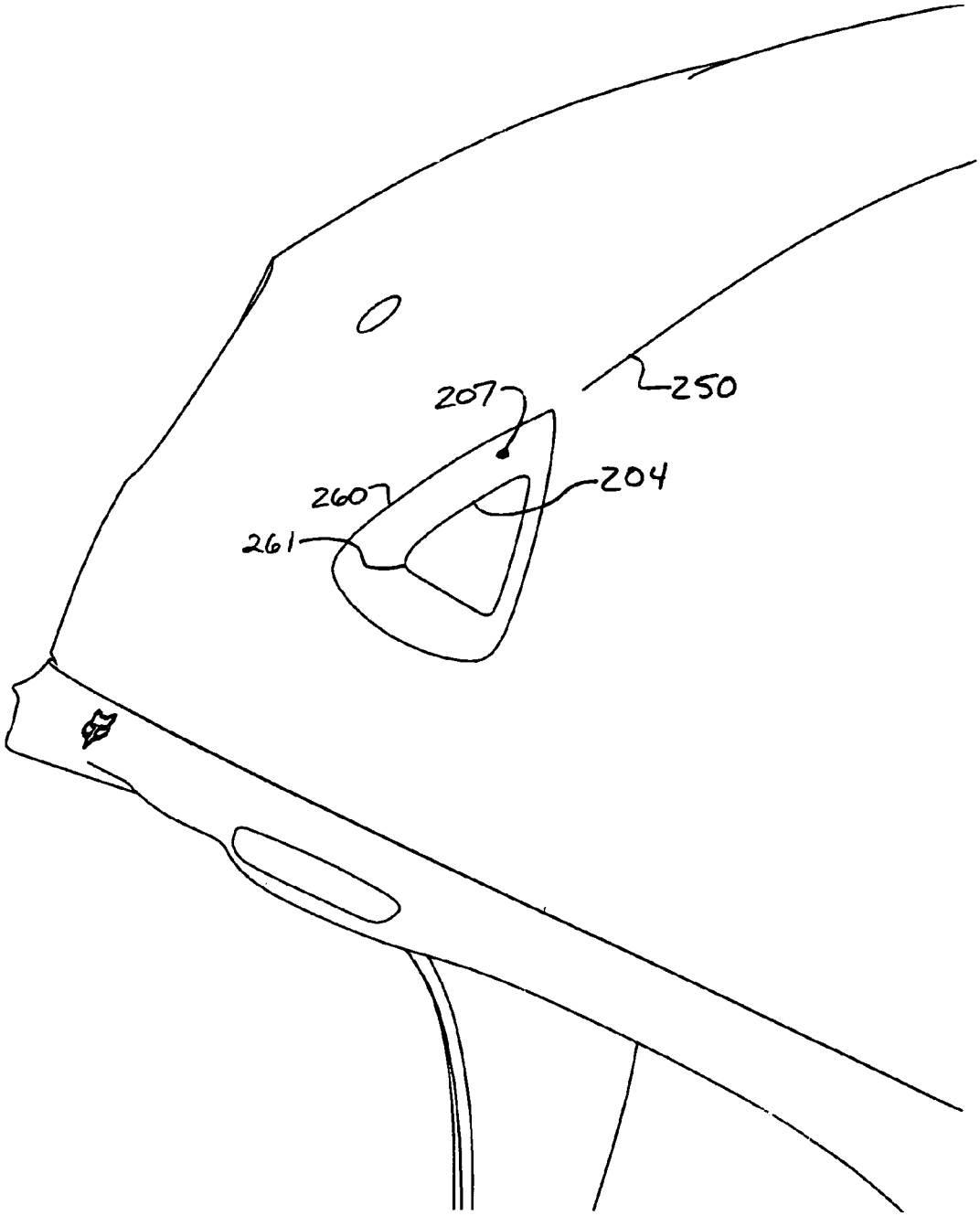
FIG. 5 is a view of a helmet according to some embodiments of the present invention
Figure 6A:
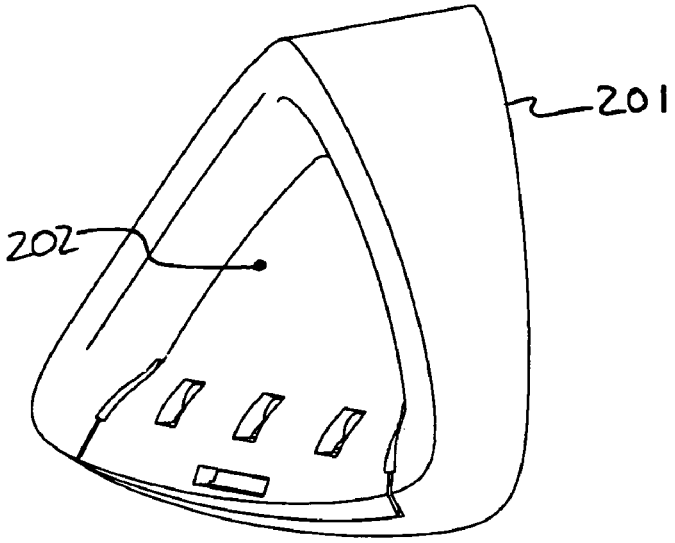
FIGS. 6A-H are perspective and orthogonal views of a vent mechanism in the closed position according to some embodiments of the present invention.
Figure 6B:
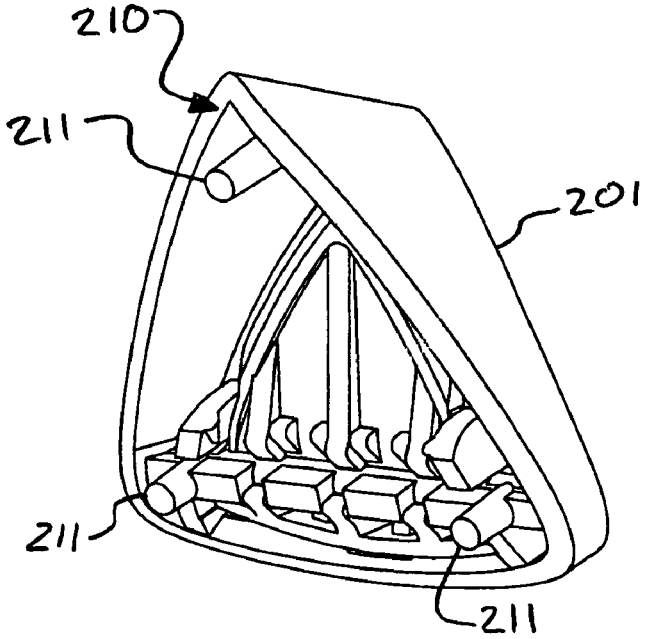
Figure 6C:
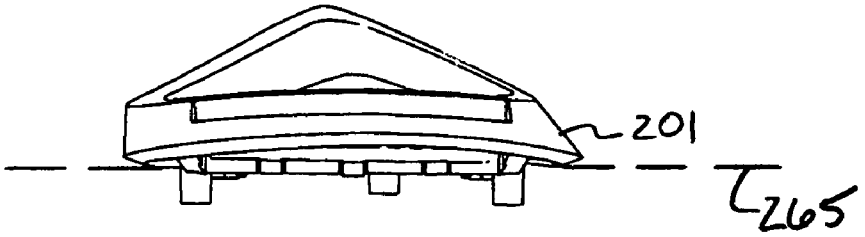
Figure 6D:
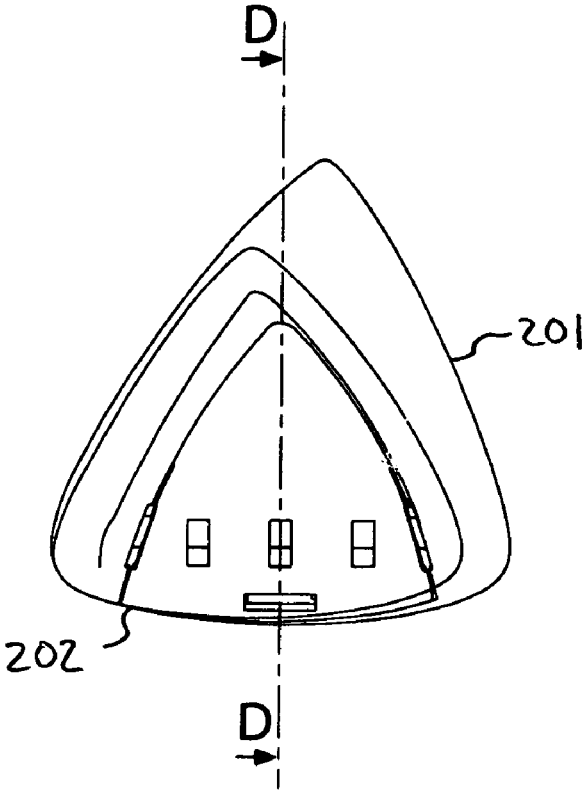
Figure 6E:
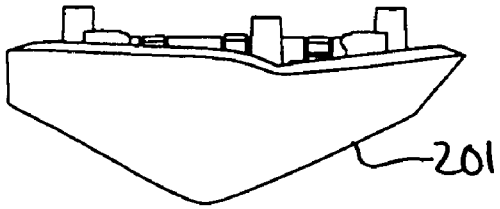
Figure 6F:
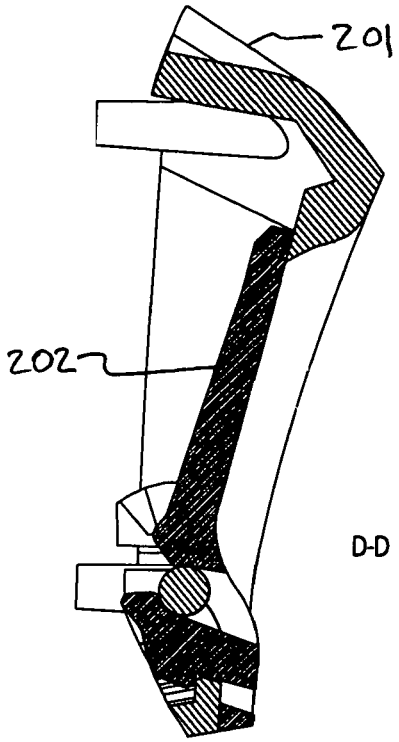
Figure 6G:
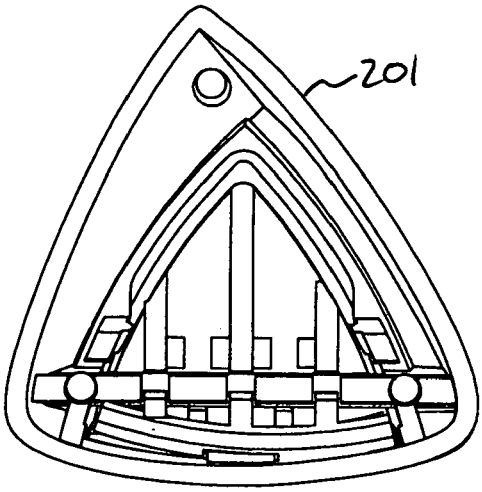
Figure 6H:
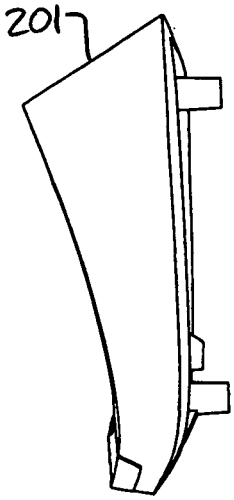

In some embodiments, as seen in FIG. 5, the outer shell of the helmet may have one or more holes 204 with a tapered portion 207. The tapered portion 207 has and inner edge 261 and an outer edge 260. The outer shell of the helmet may also have one or more raised portions 250 in some embodiments.

FIGS. 6A-H illustrate a vent mechanism in the closed position according to some embodiments of the present invention. The vent mechanism may be a two piece mechanism consisting of a base unit 201 and a vent tab 202. The vent mechanism is adapted to fulfill numerous functions with just two pieces in some embodiments. The base unit 201 may be attached to the helmet using stake posts 211. The stake posts 211 may fit into mounting holes in the outer shell of the helmet and be heat staked from the inside of the helmet shell. In some embodiments, adhesives may be used. In some embodiments, threaded fasteners may be used. In some embodiments, snaps may be used. In some embodiments, a mix of fastener types may be used. The mounting interface 210 of the base unit 201 fits snugly against the outer shell of the helmet in some embodiments. The mounting interface 210 of the base unit may not be flat, but may be a varying plane adapted to fit into the contours of the tapered portion surrounding the hole in the outer shell in some embodiments. A mounting plane 265 illustrates the plane upon which the vent mechanism would rest if not for the stake posts 211.

FIGS. 7A-H illustrate a vent mechanism in an open position according to some embodiments of the present invention. The vent tab pivots through a range of positions and may have friction locks in intermediate positions, as well as mechanical stops at the end of its range of motion. The base unit 201 may have a tab 280 which works with a snap portion 305 on the vent tab 202 to function as snap which keeps the vent tab 202 in the closed position. The vent tab 202 may be moved from the closed position by pushing on the tab portion 205 or by the lifting of the lever portion 206. The amount of force required to pivot the vent tab 202 from the snapped, closed position is in excess of the amount of force required to pivot the vent tab through other ranges of motion.

Figure 7A:
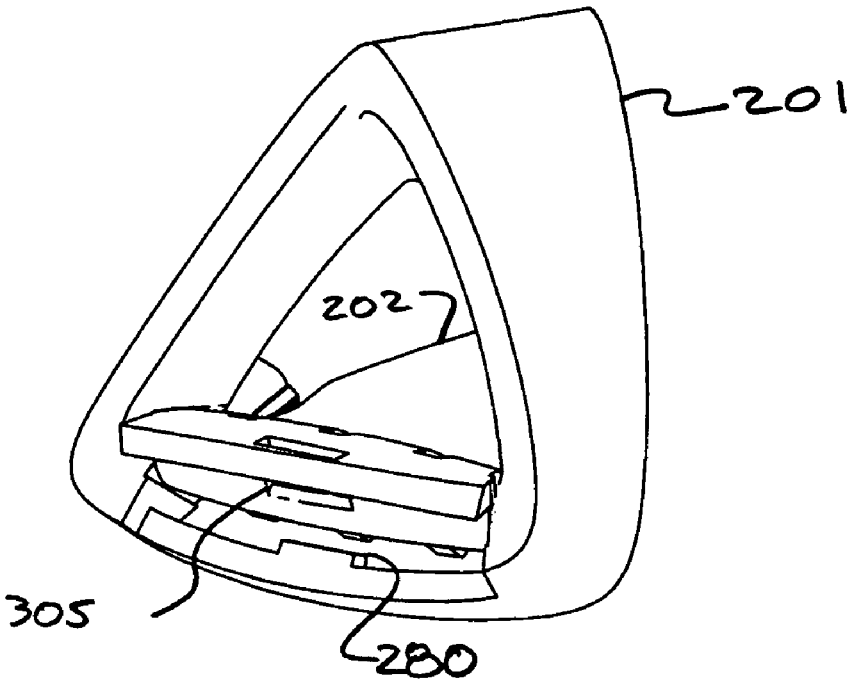
FIGS. 7A-H are perspective and orthogonal views of a vent mechanism in an open position according to some embodiments of the present invention.
Figure 7B:
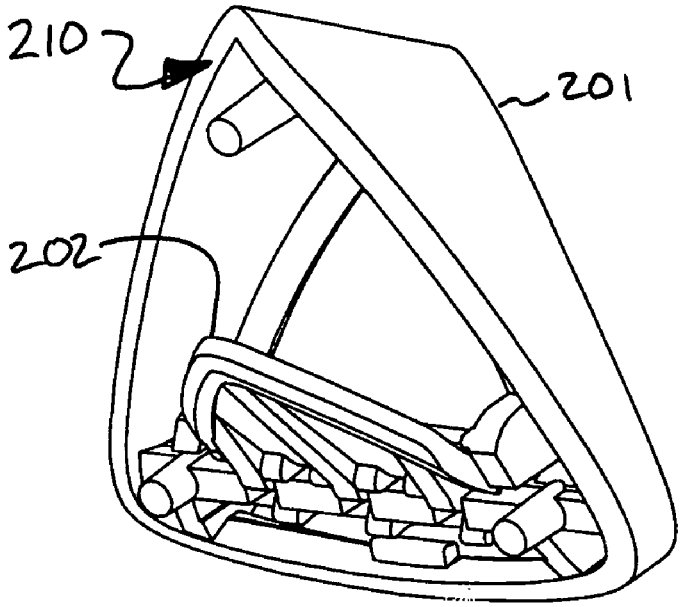
Figure 7C:
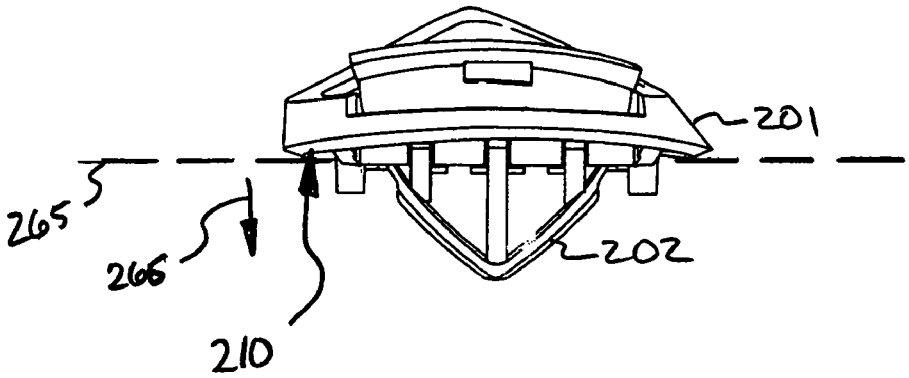
Figure 7D:
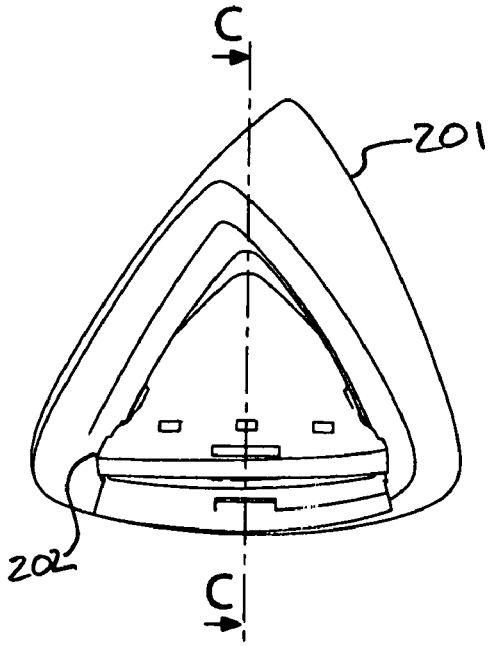
Figure 7E:
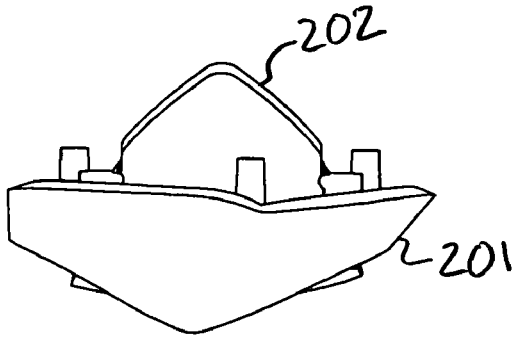
Figure 7F:
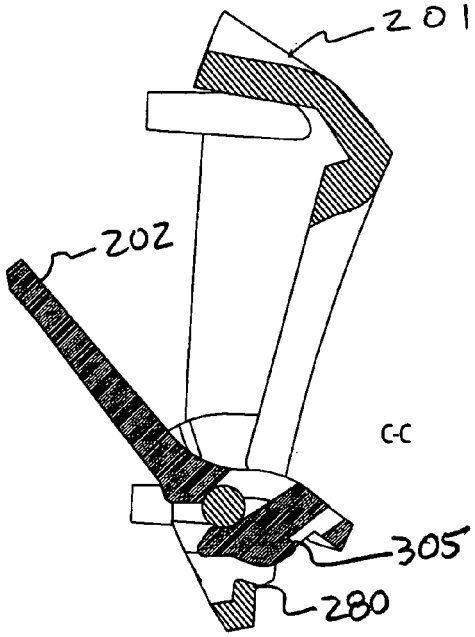
Figure 7G:
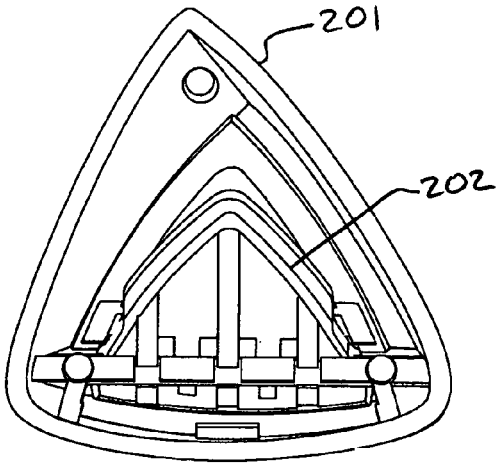
Figure 7H:
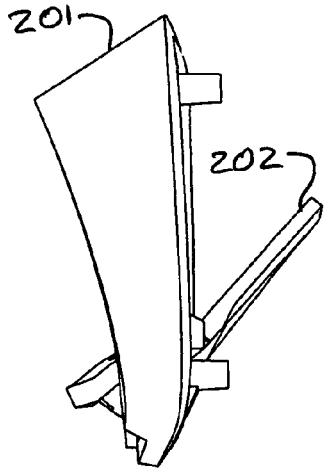
Figure 8A:
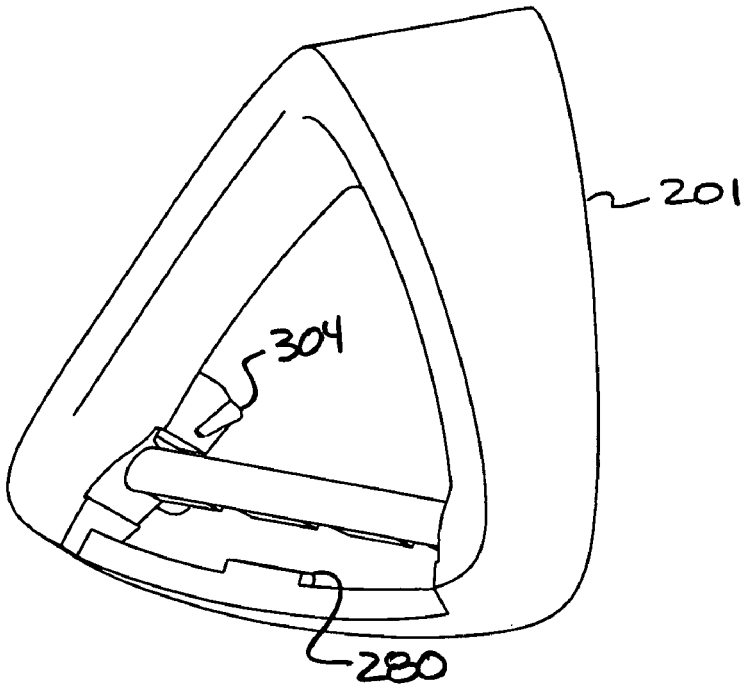
FIG. 8A-H are perspective and orthogonal views of a base unit of a vent mechanism according to some embodiments of the present invention.
Figure 8B:
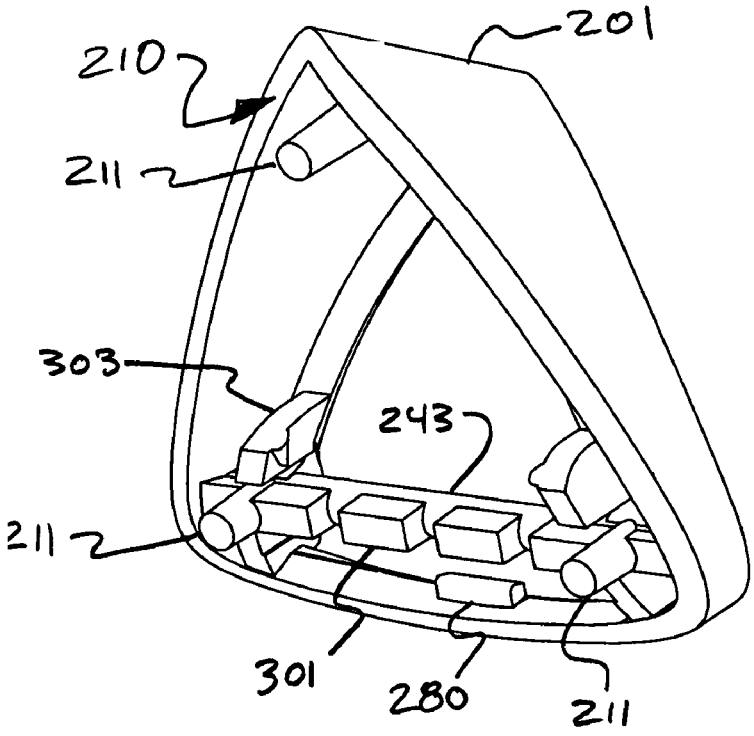
Figure 8C:
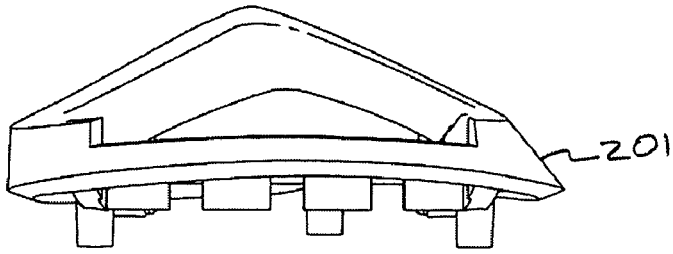
Figure 8D:
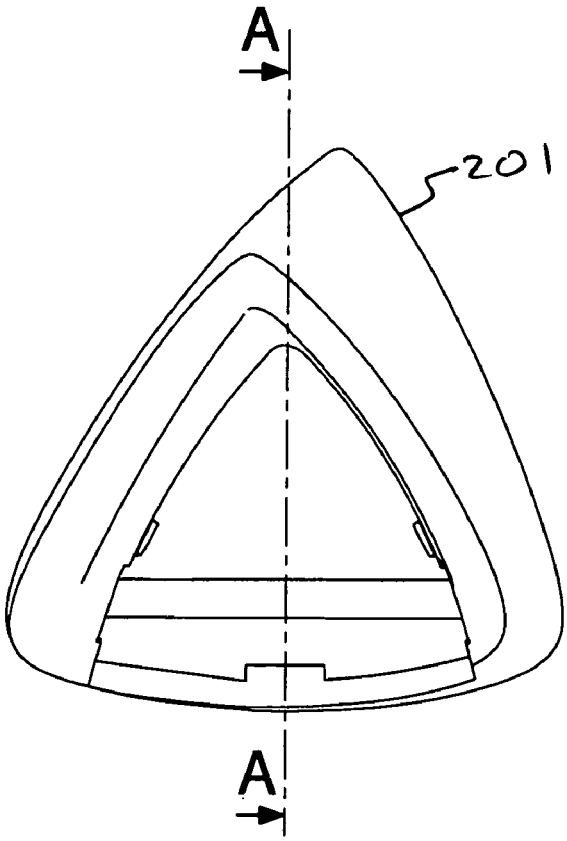
Figure 8E:
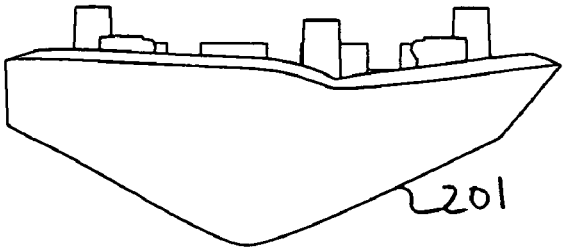
Figure 8F:
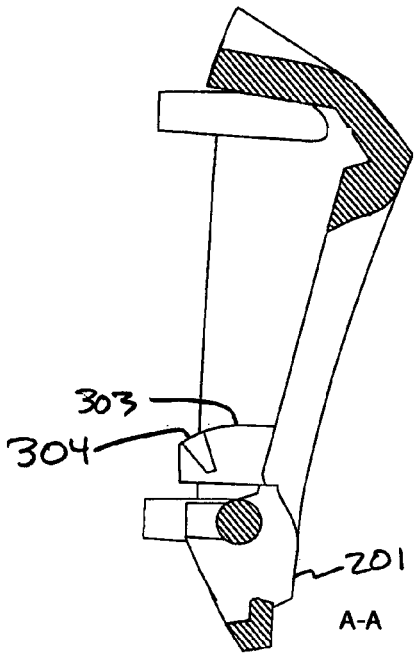
Figure 8G:
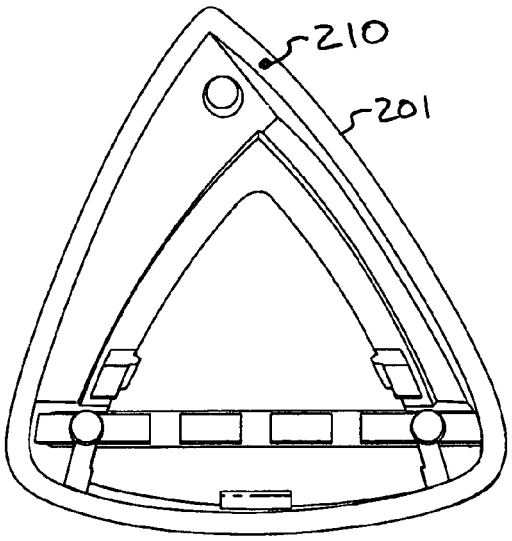
Figure 8H:
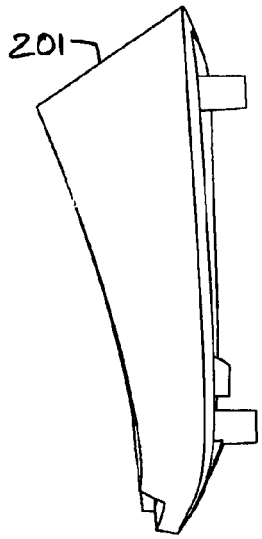
Figure 9A:
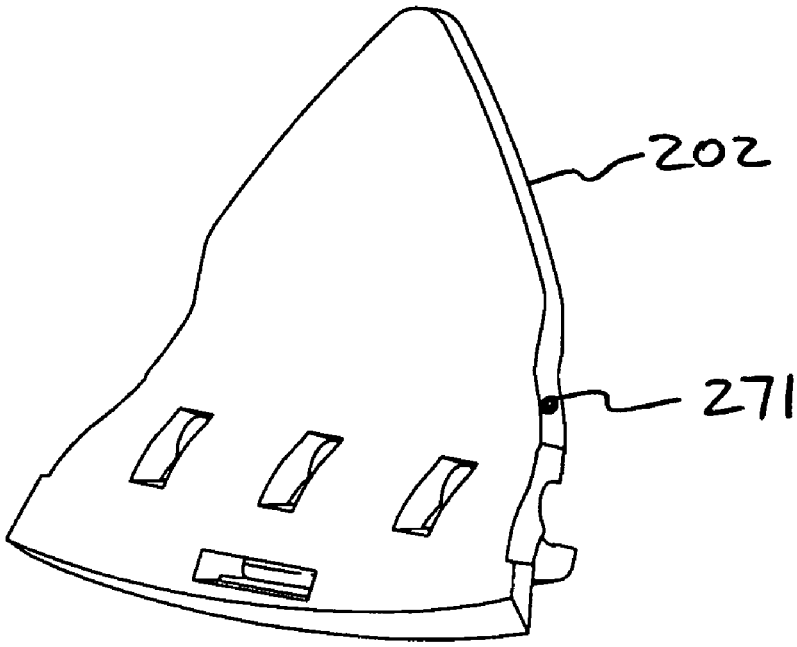
FIGS. 9A-H are perspective and orthogonal views of a vent tab of a vent mechanism according to some embodiments of the present invention.
Figure 9B:
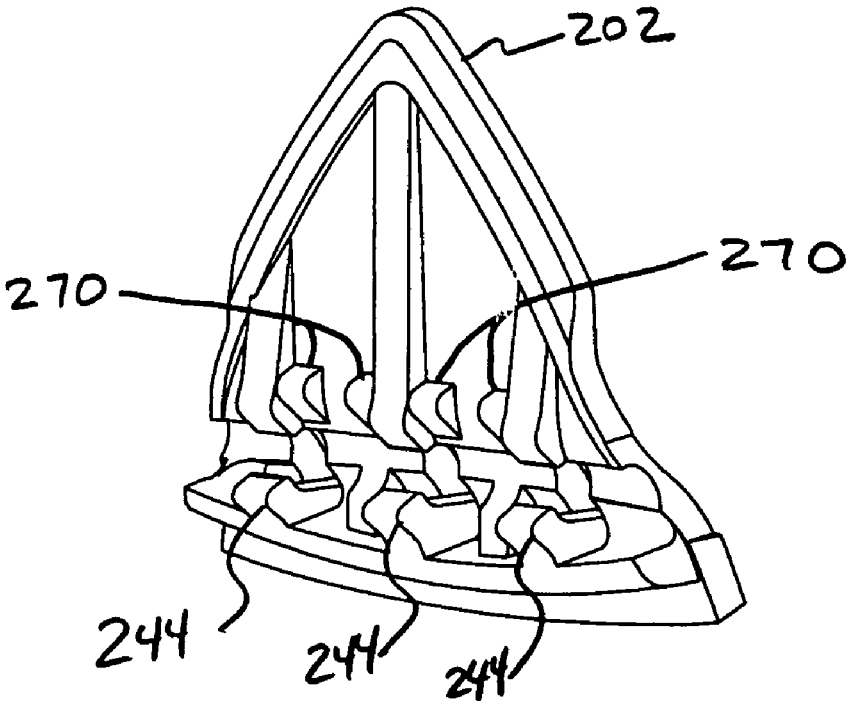
Figure 9C:
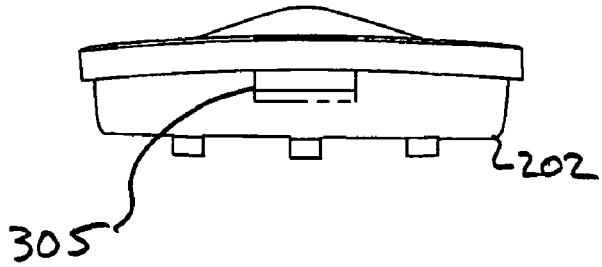
Figure 9D:
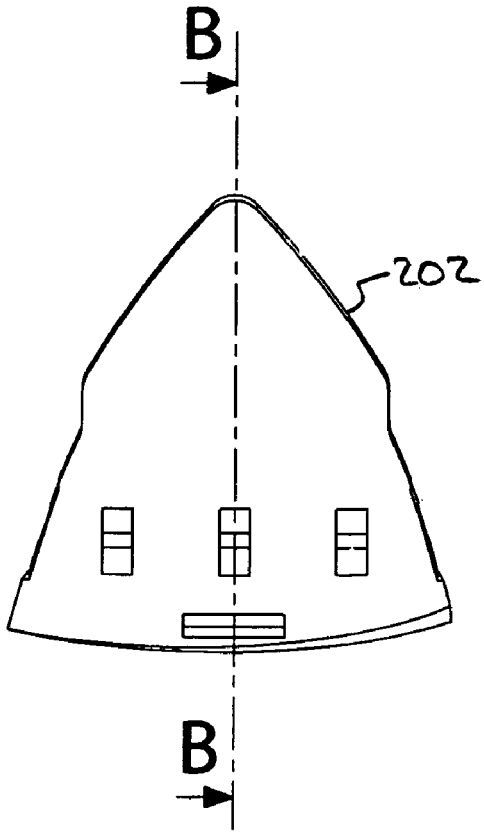
Figure 9E:
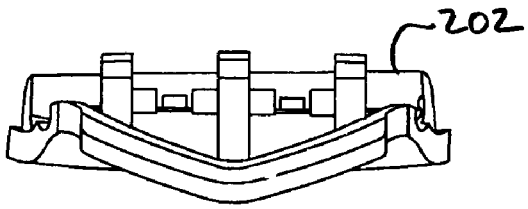
Figure 9F:
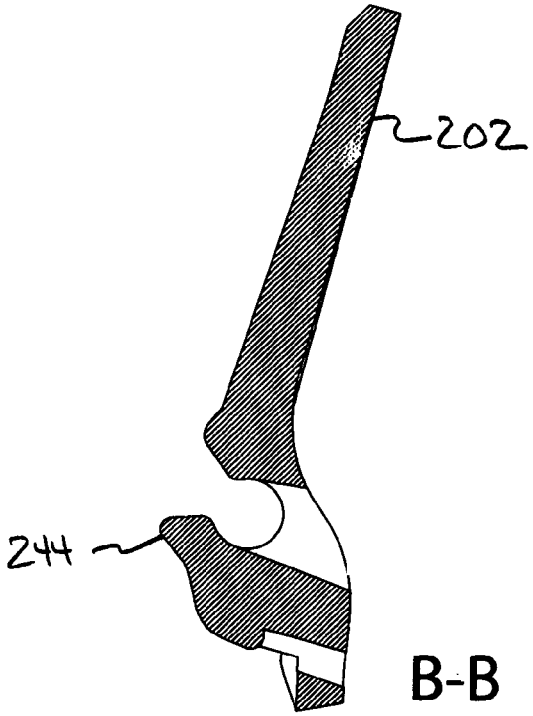
Figure 9G:
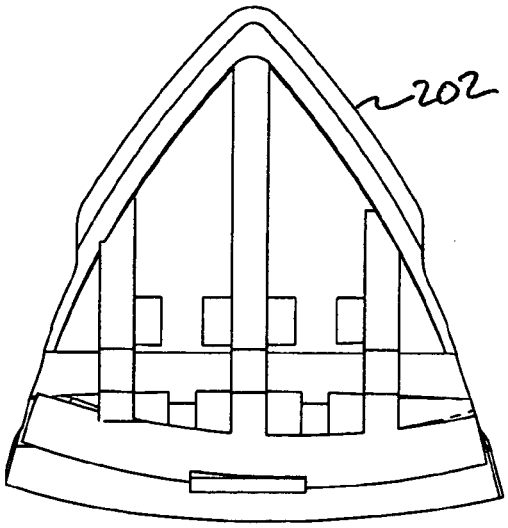
Figure 9H:
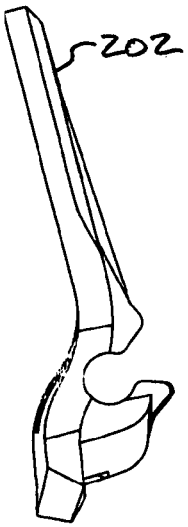

As seen in FIG. 7C, the vent tab 202 may pivot through to a position such that the tab portion of the vent tab 202 has pivoted through 266 the mounting plane 265 of the vent mechanism. In conjunction with the tapered hole in the helmet shell, this pivoting through the mounting plane allows for abundant venting using a minimum of space on the helmet shell.

FIGS. 8A-H illustrate a base unit 201 according to some embodiments of the present invention. The base unit 201 may be attached to the helmet using stake posts 211. The stake posts 211 may fit into mounting holes in the outer shell of the helmet and be heat staked from the inside of the helmet shell. In some embodiments, adhesives may be used. The mounting interface 210 of the base unit 201 fits snugly against the outer shell of the helmet in some embodiments. The mounting interface 210 of the base unit may not be flat, but may be a varying plane adapted to fit into the contours of the tapered portion surrounding the hole in the outer shell in some embodiments.

The base unit 201 may have a pivot axis 243 adapted to provide an attachment and an axis of rotation for a vent tab in some embodiments. Blocks 301 may be interspersed along the length of the pivot axis 243 to provide restriction against movement of the vent tab along the axis of rotation, as seen in FIG. 7B. A closed position tab 280 is adapted to gently clip to the lever portion of the vent tab to clip the lever portion into the closed position. Stop arms 303 with stop tabs 304 are adapted to restrain the vent tab in a partially open position. The stop tabs 304 are adapted to provide a stop in an intermediate position such that the vent tab 202 is fixed with much higher friction in a position where it has been pivoted partially open.

FIGS. 9A-H illustrate a vent tab 202 according to some embodiments of the present invention. The vent tab 202 has clips 244 which are adapted to clip onto the pivot axis of the base unit. The clips 244 provide both a physical attachment and a means of pivoting around the pivot axis. A clip 305 is adapted to clip to the closed position tab of the base unit.

The full deploy stops 270 are adapted to prevent pivoting of the vent tab 202 past a certain point. The full deploy stops 270 contact surfaces on the base unit 201 which prevent further pivoting. The area 271 mid way along the sides of the vent tab 202 are sized such that they engage the stop tabs 304 on the base unit. The stop tabs 304 engage the area 271 such that they provide and intermediate stop in the pivoting of the vent tab. The stop tabs 304 engage this area such that the rotation of the vent tab will be held with friction at this point of contact without the application of additional pressure, which will then allow the vent tab to pivot to the point where the full deploy stops 270 contact the base unit 201. The pivoting deployment of the vent tab thus has a stop holding it closed, then it may pivot with relatively low friction through a partial deployment until the vent tab engages the stop tab 304, then there is another region of relatively low friction, until the base unit contacts the full deploy stops 270.

As evident from the above description, a wide variety of embodiments may be configured from the description given herein and additional advantages and modifications will readily occur to those skilled in the art. The invention in its broader aspects is, therefore, not limited to the specific details and illustrative examples shown and described. Accordingly, departures from such details may be made without departing from the spirit or scope of the applicant's general invention.

I claim:

1. A motorcycle venting system, said system comprising:

a motorcycle helmet, said helmet comprising:

an outer shell, said outer shell comprising a face bar;

an eye opening above said face bar; and a plurality of holes through said outer shell, said plurality of holes located above said face bar in the forehead region of said helmet above said eye opening;

a plurality of vent mechanisms mounted to said holes above said face bar, said vent mechanisms affixed to said motorcycle helmet, said vent mechanisms comprising:

a base unit, said base unit comprising a central vent hole; and a vent tab, wherein said vent tab comprises:

a pivot axis;

a tab portion, said tab portion adapted to cover said central vent hole when said vent mechanism is in a closed position; and a lever portion, said lever portion outside of said outer shell;

wherein said vent tab is separated into said tab portion and said lever portion at said pivot axis, and wherein said vent tab is pivotally attached to said base unit.

2. The venting system of claim 1 wherein said base unit comprises mounting plane, wherein said mounting plane mounts to said outer shell.

3. The venting system of claim 1 wherein said vent tab is adapted to pivot from a closed position to one or more open positions.

4. The venting system of claim 2 wherein said vent tab is adapted pivot from a closed position to one or more open positions.

5. The venting system of claim 4 wherein said vent tab is adapted to pivot such that part of said vent tab pivots through said mounting plane and into said helmet.

6. The venting system of claim 1 wherein said vent tab is adapted to be pivoted from a closed position to an open position by the use of pressure on the lever portion.

7. The venting system of claim 1 wherein said helmet further comprises a tapered area surrounding said hole through said outer shell, said tapered area tapering in from the outer surface of said outer shell.

8. The venting system of claim 7 wherein said base unit comprises a mounting plane, wherein said mounting plane mounts to said outer shell.

9. The venting system of claim 8 wherein said vent tab is adapted to pivot such that part of said vent tab pivots through said mounting plane.

10. A motorcycle venting system, said system comprising:

a motorcycle helmet, said helmet comprising:

an outer shell, said outer shell comprising a face bar;

an eye opening above said face bar;

one or more holes through said outer shell, said holes located above said face bar in the forehead region of said helmet;

one or more raised portions in said outer shell, said raised portions rearward of and substantially in line with said holes, each of said raised portions creating an air flow channel inside said helmet under said raised portion; and one or more vent mechanisms, each of said vent mechanisms affixed to said motorcycle helmet at one of said one or more holes through said outer shell, said vent mechanisms comprising:

a base unit; and a vent tab, wherein said vent tab is pivotally attached to said base unit, said vent tab comprising:

a pivot axis;

a tab portion, said tab portion adapted to cover said central vent hole when said vent mechanism is in a closed position; and a lever portion, said lever portion outside of said outer shell.

11. The venting system of claim 10 wherein said base unit comprises a mounting plane, wherein said mounting plane mounts to said outer shell.

12. The venting system of claim 10 wherein said vent tab is adapted to pivot from a closed position to one or more open positions.

13. The venting system of claim 11 wherein said vent tab is adapted to pivot such that part of said vent tab pivots through said mounting plane.

14. The motorcycle venting system of claim 10 further comprising a visor, said visor mounted to said outer shell, said visor comprising a bill above said holes.

* * * * *